US011348422B2

(12) United States Patent
Brikho

(10) Patent No.: US 11,348,422 B2
(45) Date of Patent: May 31, 2022

(54) SYSTEM FOR MONITORING FIREARM MOVEMENT AND RELOCATION FROM A STORAGE LOCATION

(71) Applicant: Akeel Brikho, West Bloomfield, MI (US)

(72) Inventor: Akeel Brikho, West Bloomfield, MI (US)

( * ) Notice: Subject to any disclaimer, the term of this patent is extended or adjusted under 35 U.S.C. 154(b) by 0 days.

(21) Appl. No.: 16/510,475

(22) Filed: Jul. 12, 2019

(65) Prior Publication Data

US 2020/0074823 A1 Mar. 5, 2020

Related U.S. Application Data

(60) Provisional application No. 62/793,936, filed on Jan. 18, 2019, provisional application No. 62/767,701, filed on Nov. 15, 2018, provisional application No. 62/697,477, filed on Jul. 13, 2018.

(51) Int. Cl.
*G08B 13/14* (2006.01)
*G08B 25/10* (2006.01)

(52) U.S. Cl.
CPC ..... *G08B 13/1436* (2013.01); *G08B 13/149* (2013.01); *G08B 13/1427* (2013.01); *G08B 25/10* (2013.01)

(58) Field of Classification Search
None
See application file for complete search history.

(56) References Cited

U.S. PATENT DOCUMENTS

| | | | | |
|---|---|---|---|---|
| 5,525,966 | A * | 6/1996 | Parish | G08B 21/02 340/568.1 |
| 5,916,087 | A * | 6/1999 | Owens | F41A 23/18 5/503.1 |
| 6,400,269 | B1 * | 6/2002 | Savastano | F41C 33/06 340/568.1 |
| 6,568,116 | B2 * | 5/2003 | Hathaway | F41A 17/06 70/57.1 |
| 6,862,831 | B1 * | 3/2005 | Canaday | F41A 17/44 42/70.07 |
| 7,778,005 | B2 * | 8/2010 | Saliga | F41H 13/0025 361/232 |
| 2010/0321186 | A1 * | 12/2010 | Crook | G08B 25/10 340/568.6 |

* cited by examiner

*Primary Examiner* — Muhammad Adnan
(74) *Attorney, Agent, or Firm* — Blue Filament Law PLLC

(57) ABSTRACT

A system and method is provided for detection of movement or removal of a firearm from a storage location. The system generates a real-time alert that notifies a supervisor or owner of a firearm that movement or removal of the firearm from a stored location has occurred. The alert may be sent to a designated communication device such as a smartphone, landline phone, or to a computing device. An application (app) with a graphical user interface may be loaded on a user device to implement aspects of the firearm alert system. Movement and/or location sensors may be removeably mounted to the exit mouth of a firearm barrel, loaded in a round of ammunition (i.e., bullet), contained in a trigger lock, a slip on cover, screw on (after market) gun grips, original grips that come with the gun from a manufacturer, a bullet clip therefor, a gun lock, or an adhesive backed tile.

18 Claims, 10 Drawing Sheets

SYSTEM FOR MONITORING FIREARM MOVEMENT AND RELOCATION FROM A STORAGE LOCATION

RELATED APPLICATIONS

This application claims priority benefit of U.S. Provisional Application Ser. No. 62/793,936 filed 18 Jan. 2019; and U.S. Provisional Application Ser. No. 62/767,701 filed 15 Nov. 2018, and U.S. Provisional Application Ser. No. 62/697,477 filed 13 Jul. 2018 the contents of which are all hereby incorporated by reference.

FIELD OF THE INVENTION

The present invention in general relates to firearms and in particular, to a system for monitoring the movement or relocation of a firearm from a stored location without knowledge or permission of the firearm owner, and generation of an alert notification to the owner on a remote personal communication or computing device that the firearm has been moved from the storage location.

BACKGROUND OF THE INVENTION

Firearm ownership comes with great responsibility and liability. It is incumbent on firearm owners/supervisors to know where their firearms are at all times, and that their firearms are only used by themselves or authorized individuals. Firearms are required to be securely stored when not being carried or used by a rightful or registered user. Owners/supervisors of firearms are required to be extremely diligent and proactive in stopping firearms from being used wrongfully or without their knowledge. Currently, fourteen states now hold a firearm owner liable if someone steals their firearm and commits a crime While there are existing firearm locks and firearm safes to prevent illicit or unintended use and for storage of firearms there continues to be a need to alert firearm owners/supervisors in real-time when and if a firearm has been tampered with or moved from a stored location.

Thus, there exists a need for improved monitoring of stored firearms and for generation of alerts when movement or relocation of a firearm is detected.

SUMMARY OF THE INVENTION

A system for detection of movement or removal of a firearm from a storage location includes a monitoring device adapted for placement on or in the firearm to be monitored for movement or removal of the firearm from the storage location. A base station/local access point is in wireless communication with the monitoring device. An application (app) loaded on a remote computing or communication device interfaces with and receives notification and status alerts from the monitoring device.

A method for detection of movement or removal of a firearm from a storage location includes loading an app for monitoring for the movement and relocation of stored firearms on one or more remote computing or communication devices, loading user notification preferences and firearm information into the app, placing a monitoring device into or on the firearm, activating the monitoring device, and viewing the app for status updates on the monitored firearm.

DETAILED DESCRIPTION OF THE PREFERRED EMBODIMENTS

The present invention has utility as a system and method for detection of movement or removal of a firearm from a storage location. Embodiments of the inventive system generate a real-time alert that notifies a supervisor or owner of a firearm that movement or removal of the firearm from a stored location has occurred. As used herein, a firearm refers to hand guns, pistols, and riffles. The firearms may be single fire, semiautomatic, or automatic. Embodiments of the inventive system utilize wireless transmission technologies to transmit information about movement or change in location of a firearm. The generated notification alert may be sent to a designated communication device such as a smartphone, landline phone, or to a computing device illustratively including a tablet, laptop, and desktop computer. An application (app) with a graphical user interface may be loaded on a user device to implement aspects of embodiments of the firearm alert system.

In a specific inventive embodiments the movement and/or location sensors may be removeably mounted to the exit mouth of a firearm barrel, loaded in a round of ammunition (i.e., bullet), contained in a trigger lock, contained in a cover slip on, or screw on (after market) gun grips, contained in the original grips that come with the gun from a manufacturer, a gun lock, or an adhesive backed tile.

Embodiments of the app provide a user with a private and secure platform to view information about their firearms including type of weapon, serial or registration number, permit status, and storage location. Access to the app is protected via entry of an alphanumeric password or through biometric readings of the user including fingerprint, facial recognition, and voice recognition. Embodiments of the app provide a record via timestamps of when a firearm has been moved or relocated and notifies a user via an alert of a tampering occurrence. Alerts sent to a user device may be color coded with for example red meaning that a firearm is being moved and green indicating the firearm is no longer being moved or tampered with. The alerts may be shown as flashing on the screen of the user device. Information is only provided to outside authorities or non-owners of the firearms being monitored with permission of the user of the app. Emergency numbers may be stored in the app for the user to call or to be automatically called in the event the firearm has been disturb or taken from storage. In a specific embodiment the emergency calls may be automatically generated to the stored numbers. A low battery indication is provided via the app when embodiments of the monitoring devices mounted to the firearms require recharging. The app may also be used to check battery charge levels in the monitoring devices.

Figure 1:
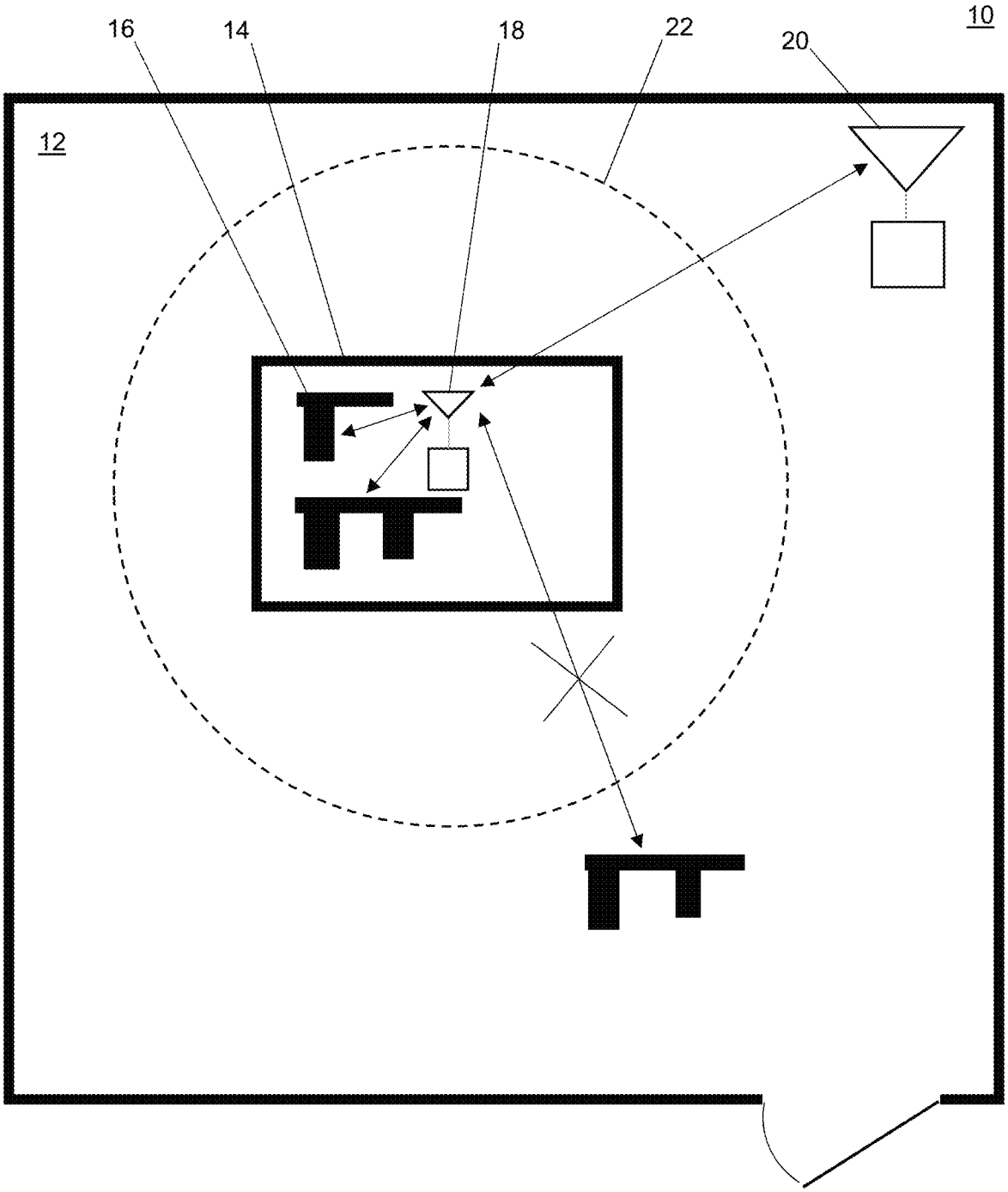
FIG. 1 illustrates a monitoring system for movement of firearms from a stored location in accordance with embodiments of the invention.

Referring now to the figures, FIG. 1 illustrates a monitoring system 10 for movement or relocation of firearms from a stored location. As shown a room 12 houses a firearm safe 14 for holding firearms 16. The firearms 16 are equipped with motion and/or location sensors as described further below that communicate wirelessly with a base station/local access point 18. The base station/local access point 18 has a wired or wireless connection to a Wi-Fi hotspot or router/modem 20 that communicates information over the Internet about the firearms 16 to a user via the app. In an inventive embodiment movement of the firearm 16 generates an alert to the user. In a further embodiment motion alone does not trigger an alert, however if the fire arm 16 is carried beyond a predefined perimeter distance 22 from the firearm safe 16 an alert is sent to the user. In an embodiment the base station/local access point 18 may lose contact with the low power transmitter attached to the firearm 16 thereby initiating an alert when the firearm is moved beyond the predefined perimeter distance 22. An optional global positioning (GPS) tracking chip may also be activated when the firearm 16 is carried beyond the predefined perimeter 22 in order to track the location of the firearm 16 in real-time.

Figure 2A:
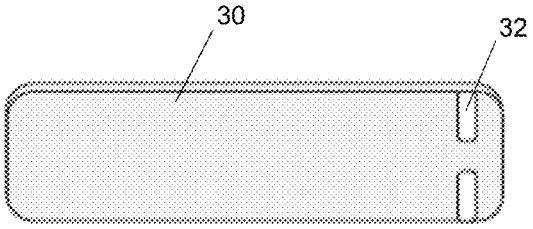
FIGS. 2A-2C illustrate a barrel plug adapter for mounting a notification sensor in accordance with a embodiments of the invention.
Figure 2B:
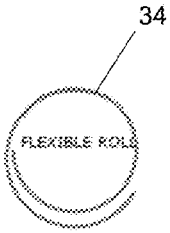
Figure 2C:
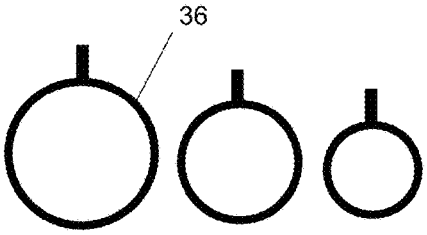
Figure 3A:
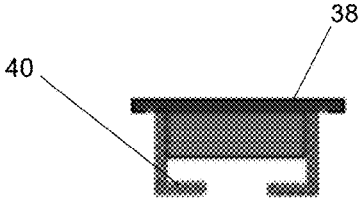
FIGS. 3A and 3B illustrate a side and top view, respectively, of a barrel plug connector in accordance with embodiments of the invention.
Figure 3B:
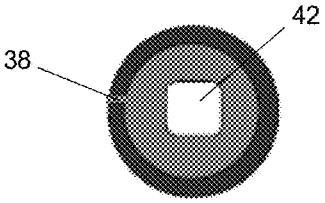
Figure 4A:
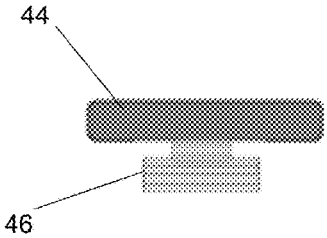
FIGS. 4A and 4B illustrate a side and top view, respectively, of an alert notification sensor in accordance with embodiments of the invention.
Figure 4B:
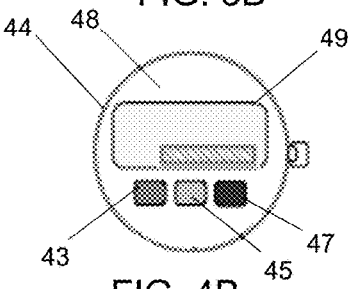
Figure 7A:
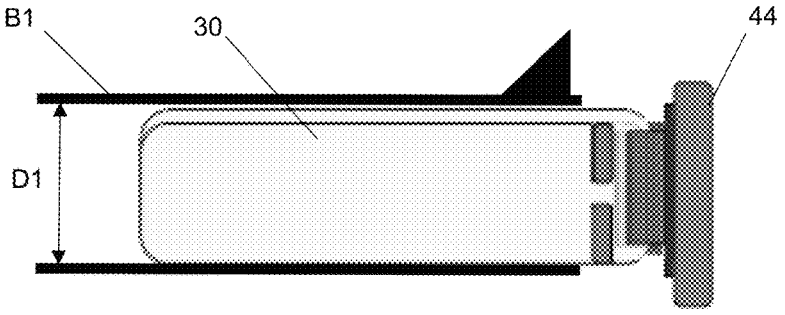
FIGS. 7A and 7B illustrate the alert notification sensor assembly mounted in a high caliber firearm barrel and in a low caliber firearm barrel, respectively, in accordance with embodiments of the invention.
Figure 7B:
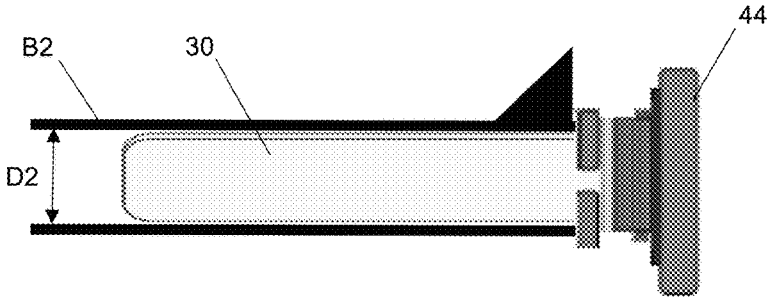

FIGS. 2A-2C illustrate an adjustable barrel plug adapter 30 for mounting a notification sensor 44 to a firearm 16. As best seen in FIG. 2B the adjustable barrel plug adapter is made of a flexible rolled material illustratively including plastic with a memory that is biased to expand outward and to unroll thereby pressing against the inner diameter wall of a firearm gun barrel. FIG. 2C illustrates various sizes of gun barrels 36 based on the caliber of the firearm. A user squeezes the barrel plug adapter 30 to fit the desired barrel 36 of the firearm to be monitored. The expandable nature of the barrel plug adapter 30 ensures a secure fit when inserted into the barrel of a firearm, no matter the caliber of the firearm as shown in FIGS. 7A and 7B, where in FIG. 7A the barrel plug adapter 30 expands to fit the higher caliber firearm 16 with a barrel B1 that has a larger inner diameter D1 then the lower caliber firearm 16 with a barrel B2 with a smaller inner diameter D2. FIG. 3A illustrates a side view of a barrel plug connector 38 that mates and secures to the barrel plug adapter 30 with clips 40 that engage slots 32 in the barrel plug adapter 30. FIG. 3B illustrates a top view the barrel plug connector 38 with a channel 42 that accommodates a male connector 46 of the alert notification sensor assembly 44 as shown in FIG. 4A. FIG. 4B illustrates a top view of an alert notification sensor assembly 44 showing a display screen 48 that has status indicators (active 43, fault 45, alert 47) and a battery charge level indicator 49. In specific embodiments the alert notification sensor assembly 44 has communication capabilities via Bluetooth or other low power transmitting protocols, a global positioning chip (GPS), and a motion detection sensor.

Figure 5:
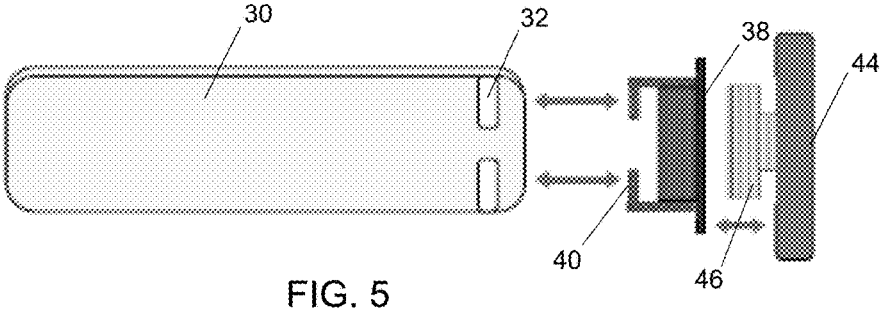
FIG. 5 illustrates an assembly exploded view of the barrel plug adapter of FIG. 2, the barrel plug connector of FIG. 3, and the alert notification sensor of FIG. 4 in accordance with embodiments of the invention.
Figure 6:
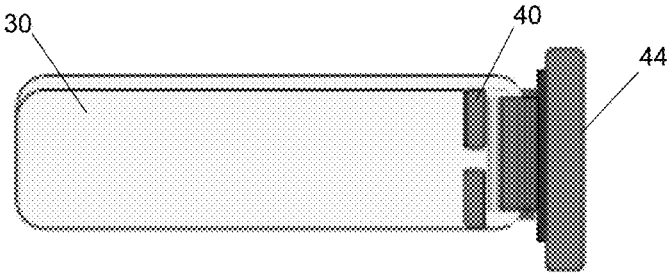
FIG. 6 illustrates the alert notification sensor of FIG. 4 assembled to the barrel plug adapter in accordance with embodiments of the invention.

FIG. 5 illustrates an assembly exploded view of the barrel plug adapter 30 of FIG. 2, the barrel plug connector 38, and the alert notification sensor 44 prior to insertion and assembly in a barrel of a firearm. FIG. 6 illustrates the alert notification sensor 44 assembled to the barrel plug 30 adapter prior to insertion and assembly in a barrel of a firearm.

Figure 8A:
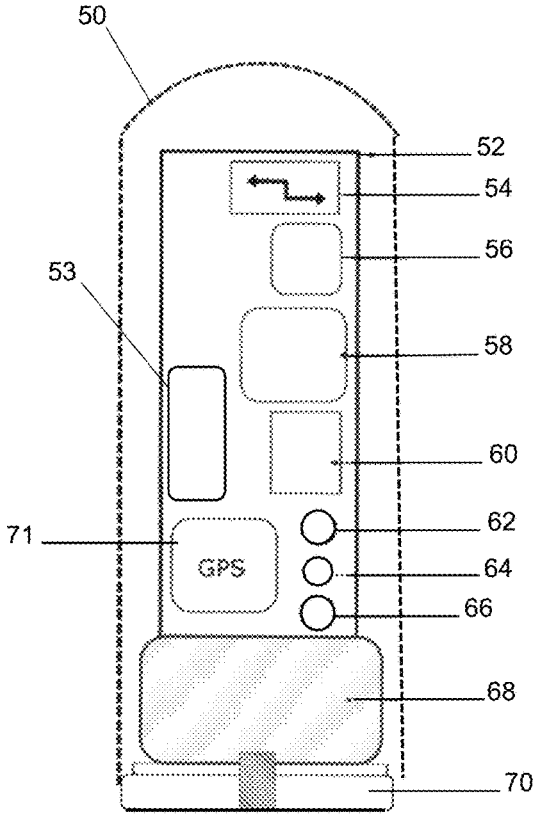
FIG. 8A is a cutaway view of a dummy bullet fitted with motion detector and tracking electronics in accordance with embodiments of the invention.
Figure 8B:
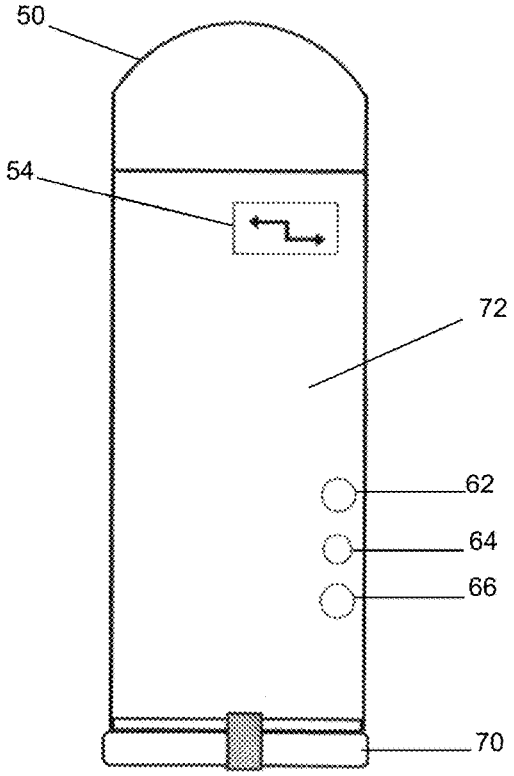
FIG. 8B illustrates the dummy bullet of FIG. 8A with a shell casing covering the motion detector and tracking electronics and showing display indicators in accordance with embodiments of the invention.
Figure 8C:
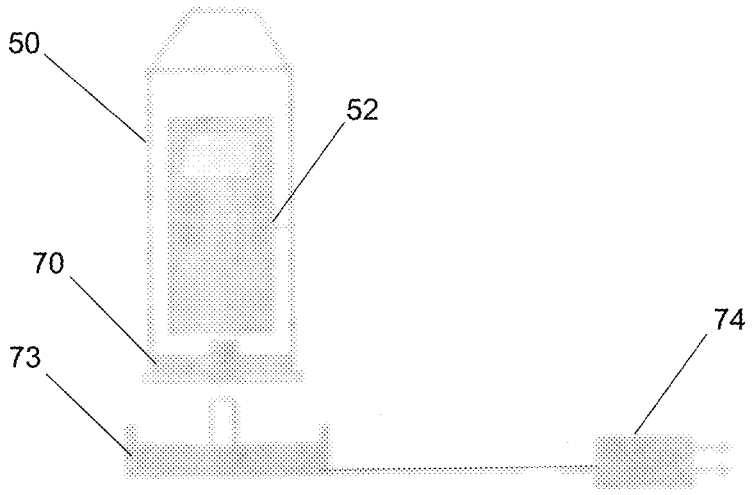
FIG. 8C illustrates a cutaway view of the dummy bullet of FIG. 8A with a charging stand with an optional transmitter/receiver in accordance with embodiments of the invention.

FIG. 8A is a cutaway view of a dummy bullet 50 fitted with a motion detector sensor 56 and tracking electronics 71. The dummy bullet 50 may have an outer casing 72 made of metal or of plastic. A miniaturized circuit board 52 is of a sufficiently small size to fit into the shell casing 72 of the majority of sizes of caliber bullets. The dummy bullet 50 may be loaded into the chamber of the firearm 16 or into an ammunition clip attached to a firearm 16. As described above the motion detector sensor 56 and optional tracking electronics 71 provide notifications to a user app in the event a firearm is moved or relocated from a storage position. Each miniaturized circuit board 52 is assigned a unique identification code that is assigned to a firearm to which the dummy bullet 50 is loaded. The unique identification codes allow multiple firearms to be monitored at a storage point. The miniaturized circuit board 52 provides distribution of electrical signals and power to components mounted to the circuit board 52 including a controller chip 53 that integrates the functions of: the motion sensor 56, a radio frequency transmitter receiver chip 58 for sending alert notifications, a memory card 60 for recording tampering and relocation events, and an optional GPS chip 71 for tracking the firearm in the event the firearm is removed beyond a designated perimeter distance from the storage case. An optional display 54 provides status information. Indicator lights include a low power warning light 62. A reset button 64 and an on/off button 66 provide external control of the dummy bullet 50 operation. A rechargeable battery 68 provides power to the internal electronics of the dummy bullet 50. The rechargeable battery 68 is charged via the base 70 with a connection for an AC/DC adapter. FIG. 8B illustrates the dummy bullet 50 of FIG. 8A with a shell casing 72 covering the motion detector and tracking electronics and showing the display indicators display 54 and warning light 62, and the reset 64 and on/off buttons 66. FIG. 8C illustrates the dummy bullet 50 with a charging stand 73 that mates with the base 70 to supply power to the rechargeable battery 68. The charging stand 73 may act as an AC/DC adapter, or the AC/DC adapter may be integrated into the electrical cord/plug 74. A transmitter/receiver may be integrated into the charging stand 73 and acts as the base station/local access point 18 that communicates with the dummy bullet 50 and receives monitoring and positional signals from motion detector sensor 56 and optional tracking electronics 71.

Figure 9:
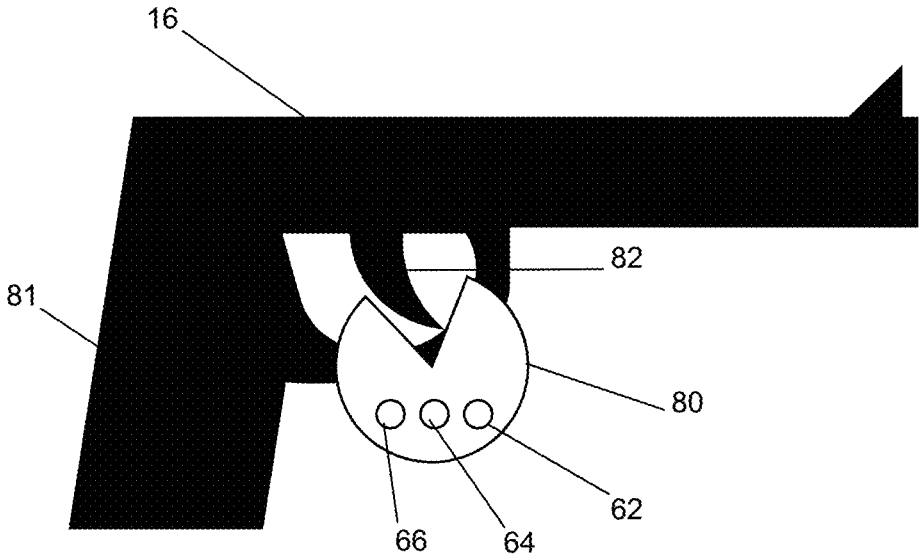
FIG. 9 illustrates a trigger guard with self-contained motion detector and tracking electronics in accordance with embodiments of the invention.

FIG. 9 illustrates a trigger guard 80 positioned to lock the trigger 82 of a firearm 16. The trigger guard 80 has a self-contained motion detector and optional tracking electronics as described in the previous inventive embodiments. An indicator light provides a low power warning light 62. A reset button 64 and an on/off button 66 provide external control of the trigger guard 80 operation. A rechargeable battery powers the trigger guard 80.

Figure 10A:
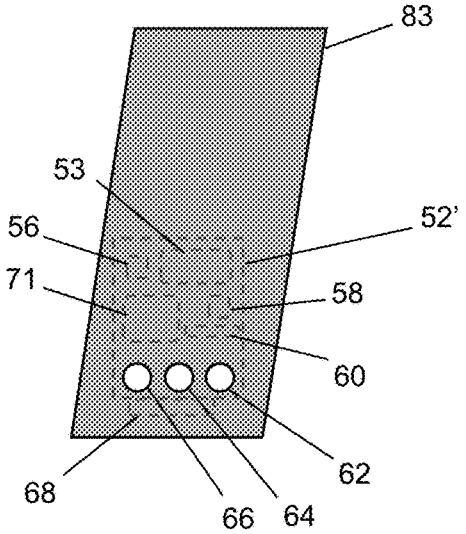
FIGS. 10A and 10B illustrate a slip on cover grip with an alert notification sensor in accordance with embodiments of the invention.
Figure 10B:
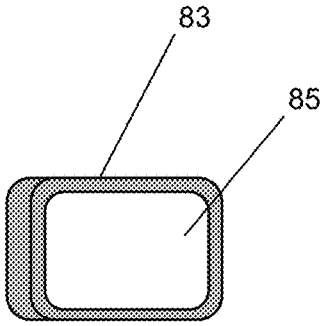

FIGS. 10A and 10B illustrate a slip on cover grip 83 with an alert notification sensor built on a miniaturized circuit board 52' that is of a sufficiently small size to fit into the wall of cover grip 83. The cover grip 83 may be made of a rubber material. The cover grip 83 fits over the grip 81 of the firearm 16. As described above the motion detector sensor 56 and optional tracking electronics 71 provide notifications to a user app in the event a firearm is moved or relocated from a storage position. Each miniaturized circuit board 52' is assigned a unique identification code that is assigned to a cover grip 83. The unique identification codes allow multiple firearms to be monitored at a storage point. The miniaturized circuit board 52' provides distribution of electrical signals and power to components mounted to the circuit board 52' including a controller chip 53 that integrates the functions of: the motion sensor 56, a radio frequency transmitter receiver chip 58 for sending alert notifications, a memory card 60 for recording tampering and relocation events, and an optional GPS chip 71 for tracking the firearm in the event the firearm is removed beyond a designated perimeter distance from the storage case. Indicator lights include a low power warning light 62. A reset button 64 and an on/off button 66 provide external control of the cover grip alert notification sensor. A rechargeable battery 68 provides power to the internal electronics of the alert notification sensor. The rechargeable battery 68 is charged via a connection for an AC/DC adapter. FIG. 10B is a top view of the slip on cover grip 83 with a cavity 85 that accommodates the insertion of the grip 81 of the firearm 16.

Figure 11A:
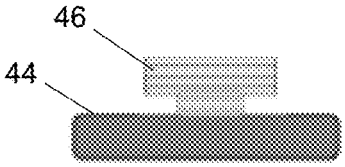
FIGS. 11A and 11B illustrate a side and bottom view, respectively, of an alert notification sensor shown also in FIGS. 4A and 4B that screws in or snaps in to the bottom the grip of a firearm in accordance with embodiments of the invention.
Figure 11B:
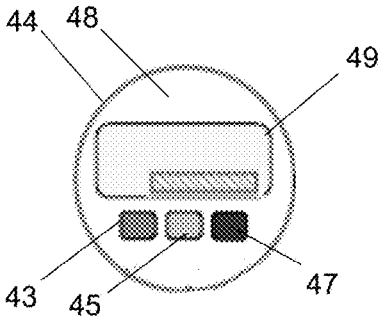
Figure 12:
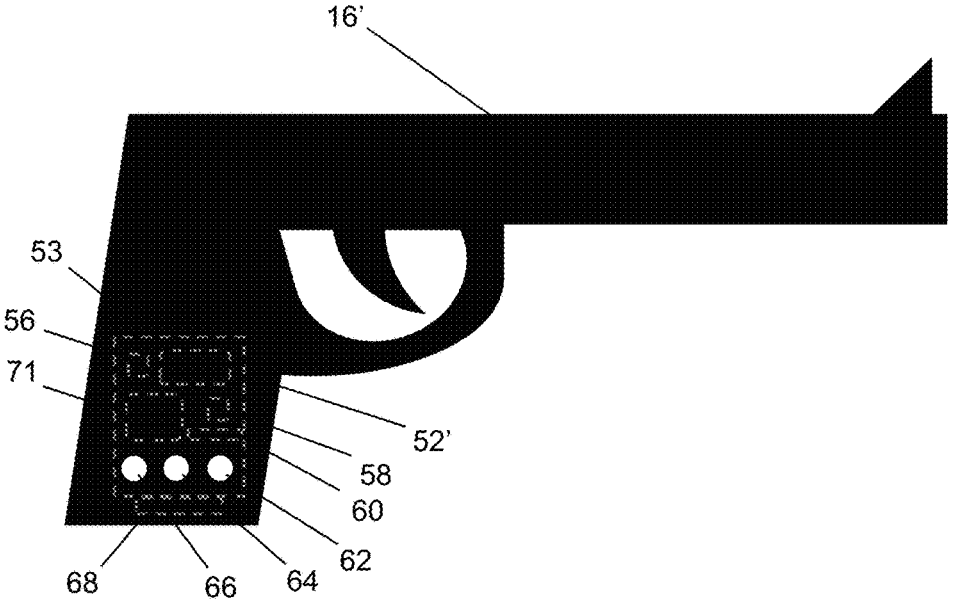
FIG. 12 illustrates a firearm with an alert notification sensor integrated into the grip of the firearm in accordance with embodiments of the invention.

FIGS. 11A and 11B illustrate a side and bottom view, respectively, of an alert notification sensor 44 shown also in FIGS. 4A and 4B that screws in or snaps in to the bottom the grip 81 of a firearm 16. FIG. 11B illustrates a display screen 48 that has status indicators (active 43, fault 45, alert 47) and a battery charge level indicator 49 of the alert notification sensor 44. In specific embodiments the alert notification sensor assembly 44 has communication capabilities via Bluetooth or other low power transmitting protocols, a global positioning chip (GPS), and a motion detection sensor FIG. 12 illustrates a firearm with an alert notification sensor board 52' integrated into the grip of the firearm 16. The motion detector sensor 56 and optional tracking electronics 71 provide notifications to a user app in the event a firearm 16' is moved or relocated from a storage position. Each miniaturized circuit board 52' is assigned a unique identification code that is assigned to a firearm 16'. The unique identification codes allow multiple firearms to be monitored at a storage point. The miniaturized circuit board 52' provides distribution of electrical signals and power to components mounted to the circuit board 52' including a controller chip 53 that integrates the functions of: the motion sensor 56, a radio frequency transmitter receiver chip 58 for sending alert notifications, a memory card 60 for recording tampering and relocation events, and an optional GPS chip 71 for tracking the firearm 16' in the event the firearm 16' is removed beyond a designated perimeter distance from the storage case. Indicator lights include a low power warning light 62. A reset button 64 and an on/off button 66 provide external control of the alert notification sensor. A rechargeable battery 68 provides power to the internal electronics of the alert notification sensor. The rechargeable battery 68 is charged via a connection for an AC/DC adapter.

Figure 13:
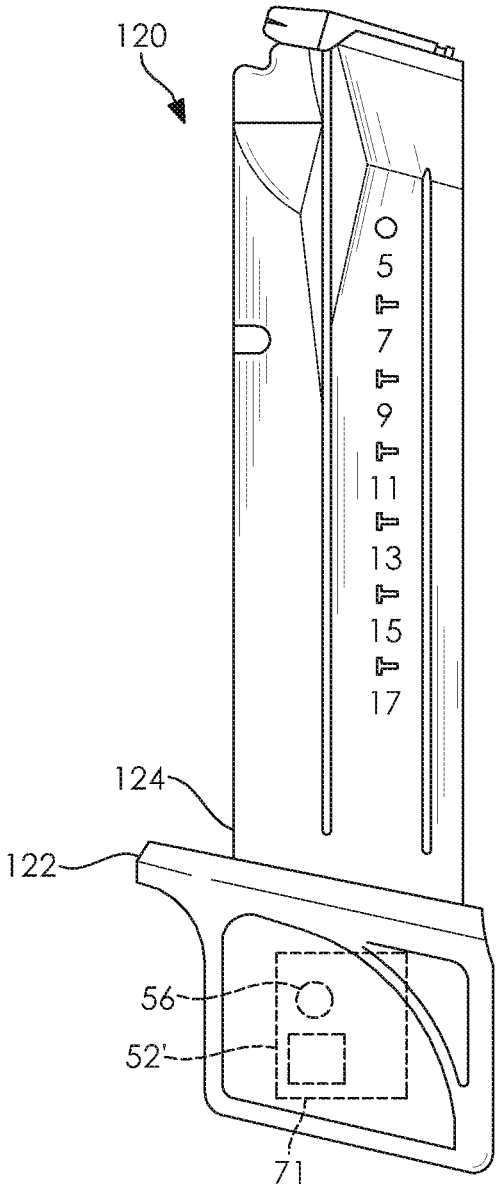
FIG. 13 illustrates a clip for a firearm with an alert notification sensor board integrated into the lock housing in accordance with embodiments of the invention.

FIG. 13 illustrates a firearm clip shown generally at 120 in which like reference numerals detailed with respect to the drawing have the meaning associated therewith with reference to the preceding drawings. The fire clip 120 has a separable extension 122 attached to the distal end 124 that in conventional form affords an additional gripping surface for clip removal and in the present invention includes an alert notification sensor board 52' integrated therein as detailed above with respect to FIG. 12. A motion detector sensor 56 and optional tracking electronics 71 provide notifications to a user app in the event the clip 120 is moved or relocated from a storage position. Each miniaturized circuit board 52' is assigned a unique identification code that is assigned to a clip 120. The unique identification codes allow multiple clips or firearms to be monitored at a storage point. The miniaturized circuit board 52' provides distribution of electrical signals and power to components mounted to the circuit board 52' as detailed with respect to FIG. 12 and are not duplicated in FIG. 13 for visual clarity, yet include a controller chip 53 that integrates the functions of: the motion sensor 56, a radio frequency transmitter receiver chip 58 for sending alert notifications, a memory card 60 for recording tampering and relocation events, and an optional GPS chip 71 for tracking the clip 120 in the event the clip 120 is removed beyond a designated perimeter distance from the storage case. Indicator lights include a low power warning light 62. A reset button 64 and an on/off button 66 provide external control of the alert notification sensor. A rechargeable battery 68 provides power to the internal electronics of the alert notification sensor. The rechargeable battery 68 is charged via a connection for an AC/DC adapter.

Figure 14:
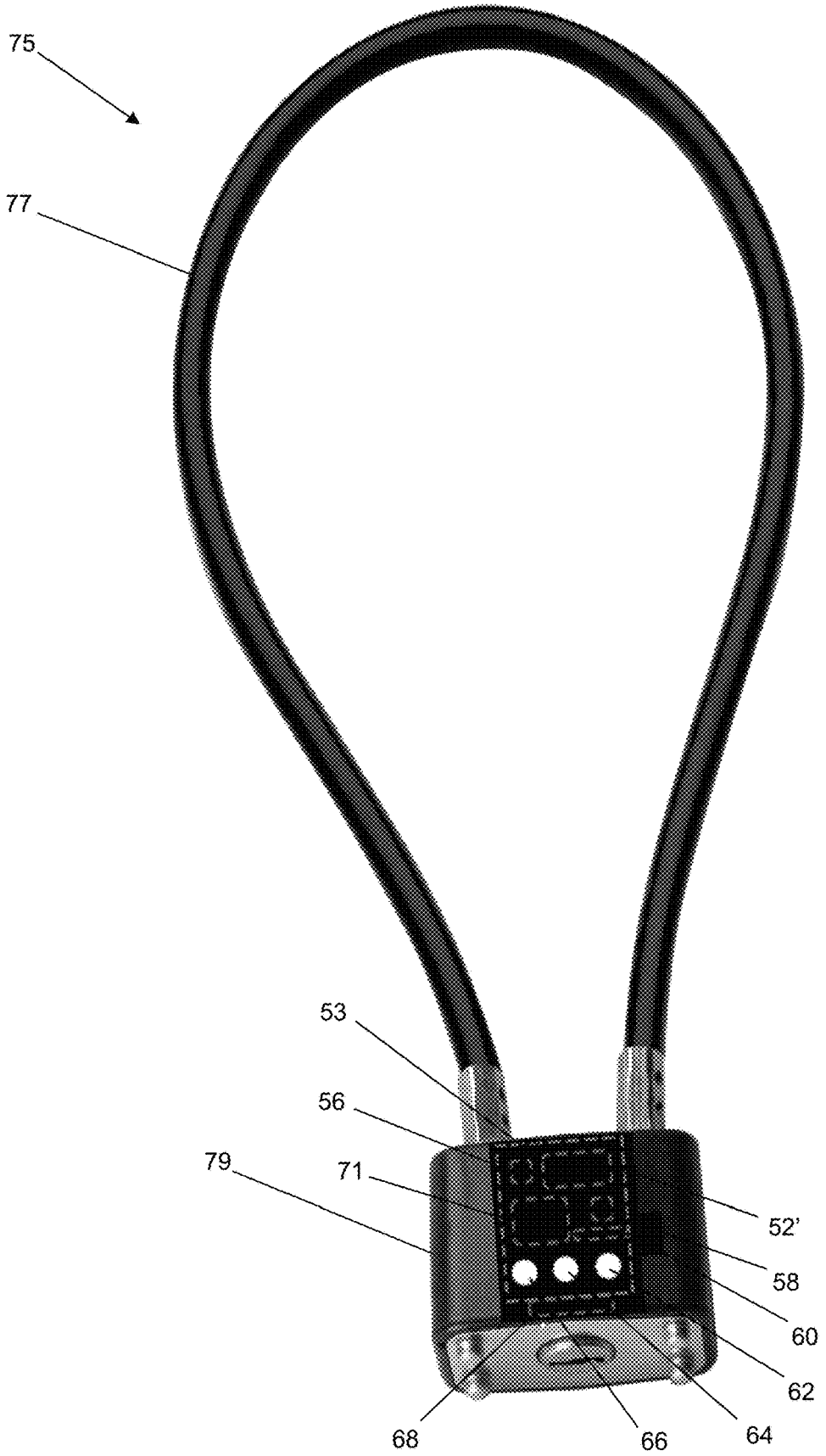
FIG. 14 illustrates a gun lock for a firearm with an alert notification sensor board integrated into the lock housing in accordance with embodiments of the invention.

FIG. 14 illustrates a gun lock 75 for a firearm with an alert notification sensor board 52' integrated into the lock housing 79. The sensor board 52' being the same as that detailed above with respect to the aforementioned figures. The lock cable 77 has a diameter that fits the widest range of calibers. The motion detector sensor 56 and optional tracking electronics 71 provide notifications to a user app in the event the lock 75 is moved or relocated from a storage position. Each miniaturized circuit board 52' is assigned a unique identification code that is assigned to a firearm 16. The unique identification codes allow multiple firearms to be monitored at a storage point. The miniaturized circuit board 52' provides distribution of electrical signals and power to components mounted to the circuit board 52' including a controller chip 53 that integrates the functions of: the motion sensor 56, a radio frequency transmitter receiver chip 58 for sending alert notifications, a memory card 60 for recording tampering and relocation events, and an optional GPS chip 71 for tracking the firearm 16' in the event the firearm 16' is removed beyond a designated perimeter distance from the storage case. Indicator lights include a low power warning light 62. A reset button 64 and an on/off button 66 provide external control of the alert notification sensor. A rechargeable battery 68 provides power to the internal electronics of the alert notification sensor. The rechargeable battery 68 is charged via a connection for an AC/DC adapter.

Figure 15:
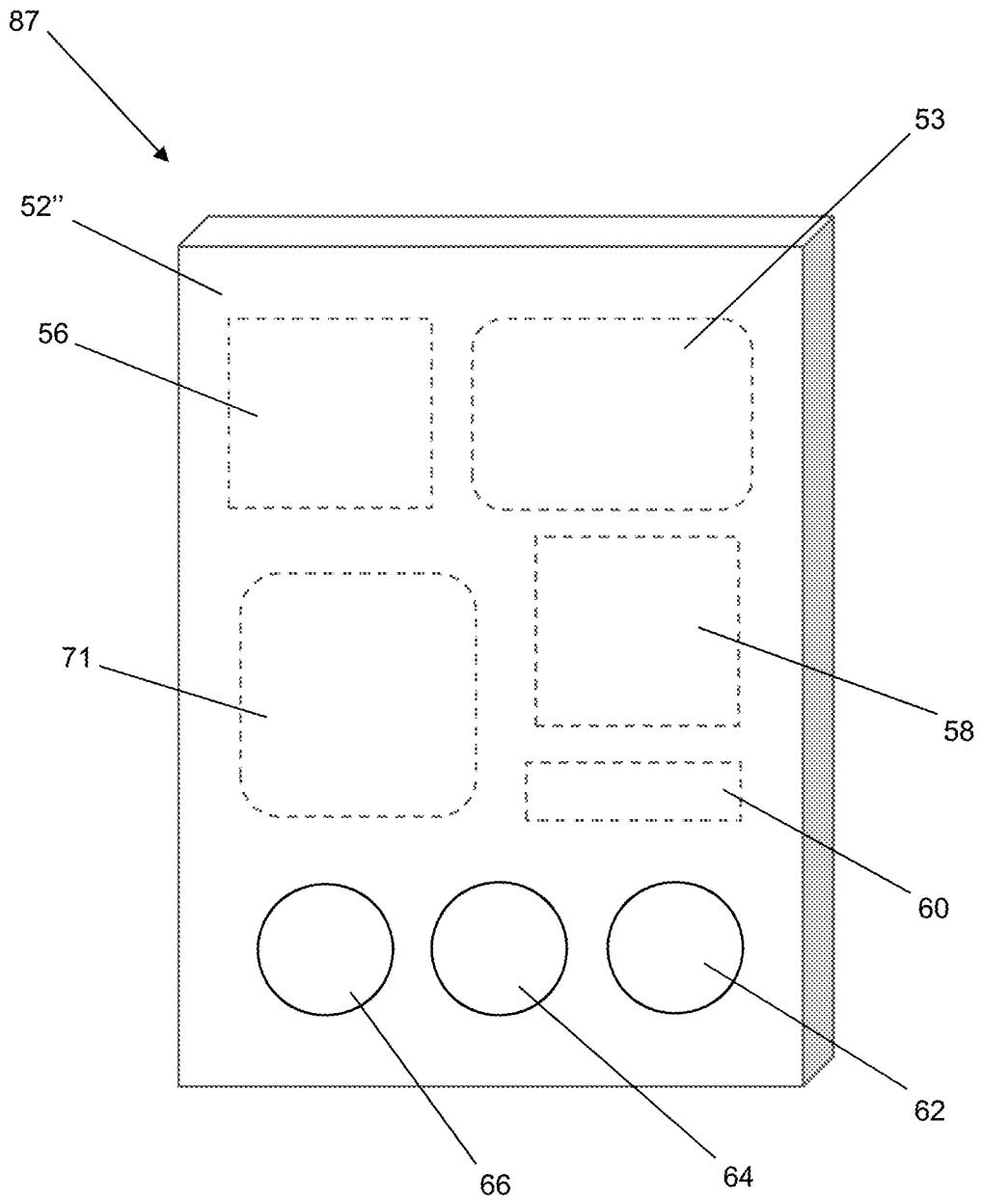
FIG. 15 illustrates an alert notification sensor adhesive backed tile in accordance with embodiments of the invention.

FIG. 15 illustrates an alert notification sensor adhesive backed tile 87 that may be adhered to a firearm 16 or to a safe door to detect motion or tampering to the firearm 16 or safe storing the firearm. The tile 87 is sized so as to fit on the grip or butt of the firearm 16. The adhesive may be permanent so that the tile 87 may not be removed once the tile is adhered to a surface. Tamper evident coverings may be applied to the tile 87 so that if removal of the tile 87 is attempted, a user will have visual evidence of the attempt at removal of the tile 87. The tile 87 may have a motion detector sensor 56 and optional tracking electronics 71 provide notifications to a user app in the event the lock 75 is moved or relocated from a storage position. Each tile 87 is assigned a unique identification code that is assigned to a firearm 16. The unique identification codes allow multiple firearms to be monitored at a storage point. A miniaturized circuit board 52" formed on the tile 87 provides distribution of electrical signals and power to components mounted to the circuit board 52" including a controller chip 53 that integrates the functions of: the motion sensor 56, a radio frequency transmitter receiver chip 58 for sending alert notifications, a memory card 60 for recording tampering and relocation events, and an optional GPS chip 71 for tracking the firearm 16 in the event the firearm 16 is removed beyond a designated perimeter distance from the storage case. Indicator lights include a low power warning light 62. A reset button 64 and an on/off button 66 provide external control of the alert notification sensor. A rechargeable battery 68 provides power to the internal electronics of the alert notification sensor. The rechargeable battery 68 is charged via a connection for an AC/DC adapter.

Figure 16:
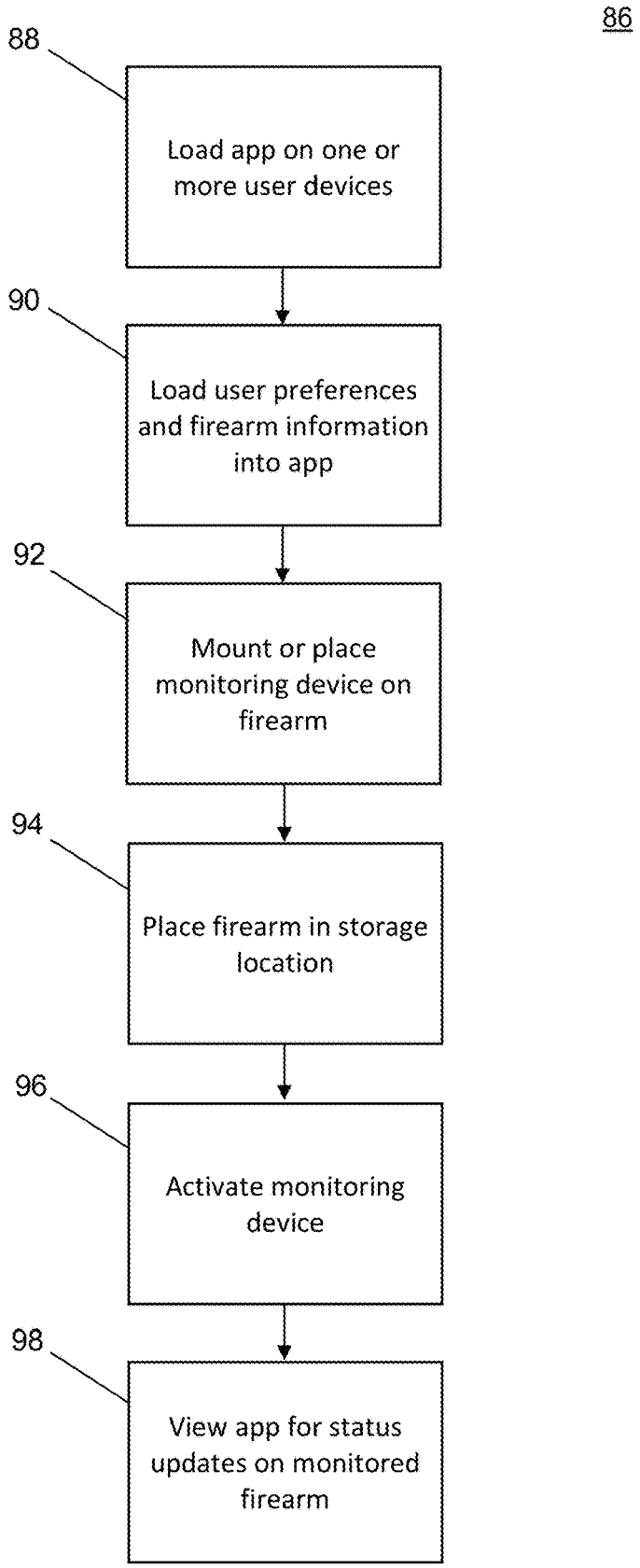
FIG. 16 is a flowchart showing a method of operation of embodiments of the invention.

FIG. 16 is a flowchart showing a method of operation of inventive embodiments of the monitoring system for movement or relocation of firearms from a stored location. A user loads the app for monitoring for the movement and relocation of stored firearms on one or more of their devices (Block 88). The user then loads user notification preferences and firearm information into the app (Block 90). The monitoring device is loaded into or on the firearm (Block 92) via the adjustable barrel plug adapter 30, dummy bullet 50, or trigger guard 80. The firearm is placed in a storage location (Block 94) and the monitoring device is activated (Block 96). The user then views the app that is installed on one or more of their devices for status updates on the monitored firearm(s) (Block 98)

Figure 17:
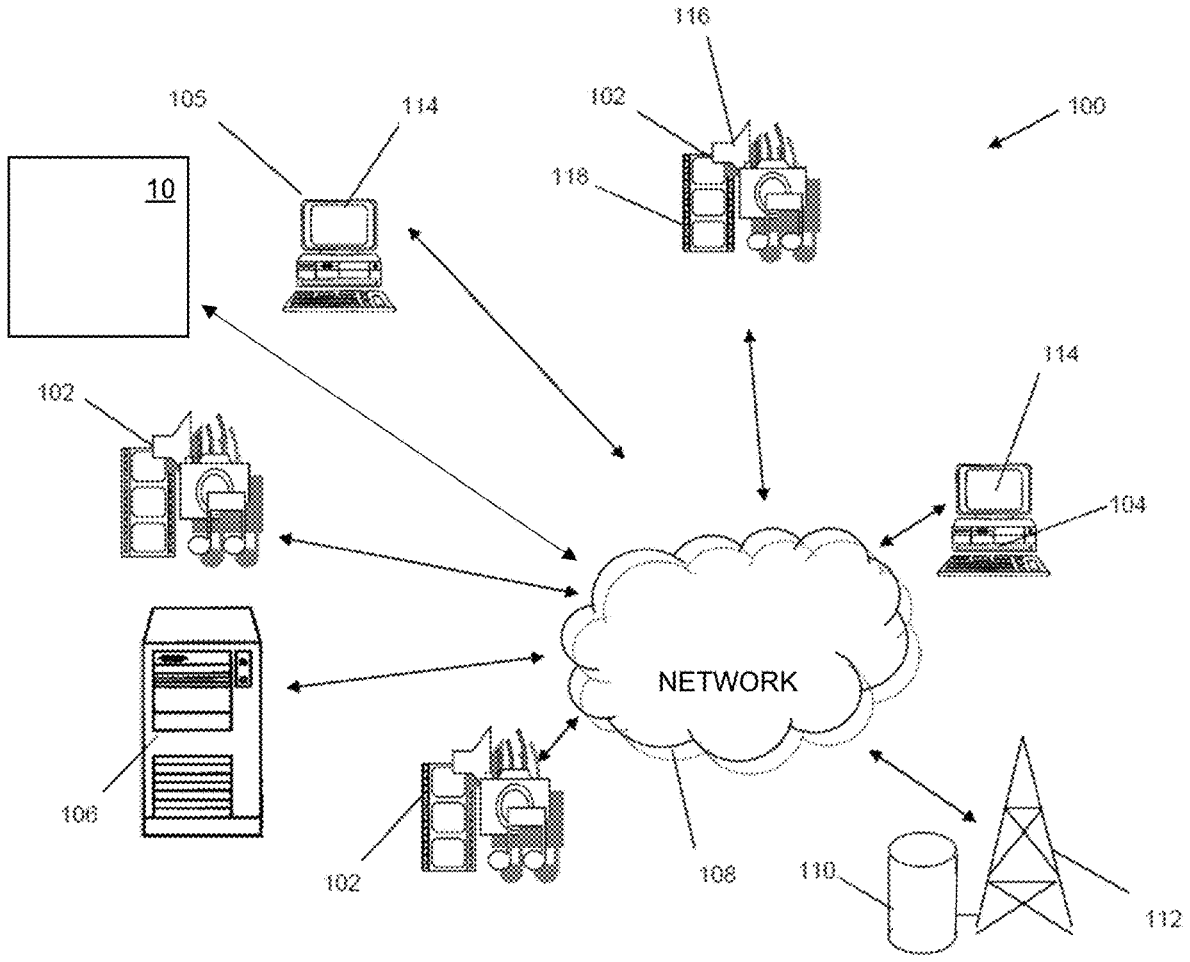
FIG. 17 is a schematic diagram illustrating an overall view of communication devices, computing devices, and mediums for implementing embodiments of the invention.

FIG. 17 is a schematic diagram illustrating an overall view of communication devices, computing devices, and mediums for implementing a system and method for monitoring movement, relocation, and tracking of firearms from a storage location.

The system 100 includes multimedia devices 102 and desktop computer devices 104 configured with display capabilities 114 and processors for executing instructions and commands, as well as running software and apps. The multimedia devices 102 are optionally mobile communication and entertainment devices, such as cellular phones, tablets, laptops, and mobile computing devices that in certain embodiments are wirelessly connected to a network 108. The multimedia devices 102 typically have video displays 118 and audio outputs 116. The multimedia devices 102 and desktop computer devices 104 are optionally configured with internal storage, software, and a graphical user interface (GUI) for carrying out elements of the system and method for monitoring movement, relocation, and tracking of firearms from a storage location according to embodiments of the invention. The network 108 is optionally any type of known network including a fixed wire line network, cable and fiber optics, over the air broadcasts, local area network (LAN), wide area network (WAN), global network (e.g., Internet), intranet, etc. with data/Internet capabilities as represented by server 106. Communication aspects of the network are represented by cellular base station 110 and antenna 112. In a preferred embodiment, the network 108 is a LAN and each remote device 102 and desktop device 104 executes a user interface application (e.g., Web browser) to contact the server system 106 through the network 108. Alternatively, the remote devices 102 and 104 may be implemented using a device programmed primarily for accessing network 108 such as a remote client.

The software for the system and method for monitoring movement, relocation, and tracking of firearms from a storage location may be resident on tablets 102, desktop or laptop computers 104, or stored within the server 106 or cellular base station 110 for download to an end user. Server 106 may be implemented as a cloud-based service for implementing embodiments of the platform with a multi-tenant database for storage of separate client data for each independent firearm owner, group, or organization.

As a person skilled in the art will recognize from the previous detailed description and from the figures and claims, modifications and changes can be made to the preferred embodiments of the invention without departing from the scope of this invention defined in the following claims.

The invention claimed is:

1. A system for detection of movement or removal of a firearm from a storage location comprising:
- a monitoring device adapted for placement on, or in the firearm to be monitored, or a bullet clip therefor for movement or removal of the firearm from the storage location;
- the monitoring device includes:
  - a first section and a second section;
  - the first section comprising recesses is configured to expand when inserted into a barrel of the firearm;
  - the second section comprises clips and monitoring circuitry, wherein the second section is attached with the first section by inserting the clips into the recesses;
- a base station/local access point in wireless communication with said monitoring device; and
- an application (app) loaded on a remote computing or communication device that interfaces with and receives notification and status alerts from the monitoring device when the firearm is moved beyond a predefined perimeter of the storage location.

2. The system of claim 1 further comprising a Wi-Fi hotspot or router/modem; and
- wherein said base station/local access point has a wired or wireless connection to said Wi-Fi hotspot or router/modem that communicates over the Internet to said app.

3. The system of claim 1 wherein said monitoring device generates said notification alert in response to movement of said firearm.

4. The system of claim 1 wherein said monitoring device further comprises a motion detection sensor.

5. The system of claim 1 wherein said monitoring device generates said notification alert in response to relocation of said firearm beyond a predefined perimeter about said storage location.

6. The system of claim 5 wherein said monitoring device further comprises a low power transmitter; and wherein said base station/local access point loses contact with said low power transmitter when the firearm is moved beyond the predefined perimeter distance.

7. The system of claim 6 wherein said monitoring device further comprises a global positioning (GPS) tracking chip, where said GPS chip is activated when said firearm is carried beyond the predefined perimeter.

8. The system of claim 1 further comprising a slip on cover grip adapter for mounting said monitoring device to said firearm.

9. The system of claim 8 wherein said cover grip is made of a rubber material.

10. The system of claim 1 further comprising a screw on adapter for said monitoring device, said screw on adapter having a male connector to secure said monitoring device to said firearm.

11. The system of claim 10 wherein said monitoring device further comprises a display screen having a set of status indicators and a battery charge level indicator.

12. The system of claim 1 wherein said monitoring device is mounted to a miniaturized circuit board, said miniaturized circuit board is fitted in a grip of the firearm, contained in a wall of a slip on grip cover, in a gun lock, or fitted to an adhesive backed tile.

13. The system of claim 12 wherein said miniaturized circuit board is assigned a unique identification code.

14. The system of claim 12 wherein said miniaturized circuit board further comprises a display, a set of indicator lights, a reset button, and an on/off button.

15. The system of claim 12 wherein said miniaturized circuit board further comprises a rechargeable battery in electrical contact with said miniaturized circuit board.

16. The system of claim 15 further comprising a charging stand that mates with the rechargeable battery for charging said rechargeable battery.

17. The system of claim 16 wherein said charging stand further comprises a transmitter/receiver acting as said base station/local access point.

18. A method of using the system of claim 1 comprises:

loading the app for monitoring for the movement and relocation of stored firearms on one or more remote computing or communication devices;

loading user notification preferences and firearm information into the app;

placing the monitoring device on, or into the firearm or a bullet clip therefor;

activating the monitoring device; and viewing the app for status updates on the monitored firearm.

* * * * *